US005556274A

United States Patent [19]

Ettie et al.

[11] Patent Number: 5,556,274

[45] Date of Patent: Sep. 17, 1996

[54] DRYING APPARATUS AND METHOD FOR PUMPABLE MATERIALS

[75] Inventors: Gordon E. Ettie, Minneapolis; Richard W. Ozer, Golden Valley, both of Minn.

[73] Assignee: Hosokawa Bepex Corporation, Minneapolis, Minn.

[21] Appl. No.: 404,254

[22] Filed: Mar. 15, 1995

[51] Int. Cl.[6] ..... F27D 1/08

[52] U.S. Cl. ..... 432/159; 432/95; 432/99; 34/372; 34/594

[58] Field of Search ..... 432/95, 96, 99, 432/101, 159; 34/372, 594

[56] References Cited

U.S. PATENT DOCUMENTS

| | | | |
|---|---|---|---|
| 1,041,523 | 10/1912 | Smith . | |
| 4,249,891 | 2/1981 | Noyes et al. | 432/14 |
| 4,334,859 | 6/1982 | Minegishi et al. | 432/13 |
| 4,424,634 | 1/1984 | Christianus | 34/167 |
| 4,454,661 | 6/1984 | Klein et al. | 34/57 |
| 4,619,606 | 10/1986 | Numberger | 432/99 |
| 4,708,159 | 11/1987 | Lockwood, Jr. | 137/340 |
| 4,992,043 | 2/1991 | Lockwood, Jr. | 432/58 |
| 5,252,061 | 10/1993 | Ozer | 432/25 |

*Primary Examiner*—Henry A. Bennett
*Assistant Examiner*—Siddmarth Ohri
*Attorney, Agent, or Firm*—Rockey, Rifkin & Ryther

[57] ABSTRACT

A particulate material drying apparatus and method including a pulse combustor and an associated combustion chamber. Fuel and combustion air are introduced to the combustion chamber whereby the combination of the pulse combustor and combustion chamber generates a pulsating flow of hot gases. A material feed introduction chamber receives the hot gases and material to be dried is delivered into the introduction chamber for contact therein with the flow of hot gases. A drying chamber is connected to the introduction chamber for receiving the mixture of material and hot gases exiting from the introduction chamber. The drying chamber comprises an enclosing wall, a porous inner wall spaced inwardly from the enclosing wall, and an annular space defined between the enclosing wall and the porous inner wall. Fluid under pressure is introduced to the annular space whereby the fluid passes through the porous inner wall and deters build-up of material on the inner surface of the porous inner wall.

12 Claims, 2 Drawing Sheets

DRYING APPARATUS AND METHOD FOR PUMPABLE MATERIALS

BACKGROUND OF THE INVENTION

This invention relates to an apparatus and method for achieving drying of moist particulate material. The invention will be described for use in conjunction with pulse combustion drying systems, however, other applications of the invention are contemplated and will be apparent to the skilled worker.

An example of a pulse combustion drying system is described in U.S. Pat. No. 5,252,061. As related therein, such systems involve the introduction of moist material into the apparatus, the drying of the material, and the collection of the material from a drying chamber. In a typical application, the material entering the apparatus will be in the form of a pumpable solution or slurry, and the system will result in a dry powder exiting from the drying chamber.

Such a system more specifically comprises the use of pulse combustion for assisting in the drying function. Pulse combustion drying generally relates to the provision of a pulse combustor and associated combustion chamber with fuel being introduced into the combustion chamber. The fuel is mixed with air in the combustion chamber, and this mixture is periodically self-ignited to create high frequency, high energy, sonic pulsations.

A tail pipe is associated with the combustion chamber for achieving release of the hot gases from the combustion chamber on a periodic basis. In the operation of such a system, the momentum of the combustion products issuing from the combustion chamber as a result of ignition and explosion will create a reduced pressure in the combustion chamber to draw in a new air and fuel charge which is again self-ignited to achieve the next explosion. The result achieved with a pulse combustor of this type constitutes a pulsating flow of hot gases issuing from the tail pipe.

In a typical system, the pulsating flow of hot gases is brought into contact with a slurry of material introduced to a material introduction chamber located at the exit end of the tail pipe. Atomization is achieved at this point and drying is continued in the drying chamber positioned downstream of the material introduction chamber.

SUMMARY OF THE INVENTION

The apparatus and method of this invention relate primarily to the drying functions of the drying chamber. This drying chamber comprises a relatively large vessel with surrounding walls for confining the mixture of gases and atomized material received from the material introduction chamber.

The invention is particularly concerned with the fact that materials being treated, particularly in the case of sticky materials such as sugars, which require an extended amount of time to become free flowing, have a tendency to adhere to the inside chamber surfaces and this leads to operating inefficiencies from the standpoint of product degradation due to overheating and equipment maintenance necessitated by equipment shut down. To avoid such problems, the invention contemplates modifications of the chamber structure and in the related operating steps.

Specifically, the invention provides for a porous inner wall structure spaced inwardly of the chamber wall. An annular space is defined between the chamber wall and inner wall, and means are provided for introducing air or other fluid into this annular space. When using air, and by maintaining the air under pressure, the air is forced through the porous wall and thereby serves to deter material build-up on the wall. Specifically, it is believed that a thin film of air will form on the inner wall surface thereby avoiding or minimizing impact of material on the surface as the material moves within the drying chamber.

The porous inner wall may be composed of a plurality of panels. Struts or other support members may be attached on the inside of the chamber wall with the panels being welded or otherwise attached to the struts.

The invention contemplates subdividing the annular passages and thereby controlling the amounts and/or characteristics of air or other fluids delivered at different locations of the chamber. Such structural arrangements may vary depending upon the types of materials being handled or the degree of control needed to deter the material build-up.

DETAILED DESCRIPTION OF THE INVENTION

Figure 1:
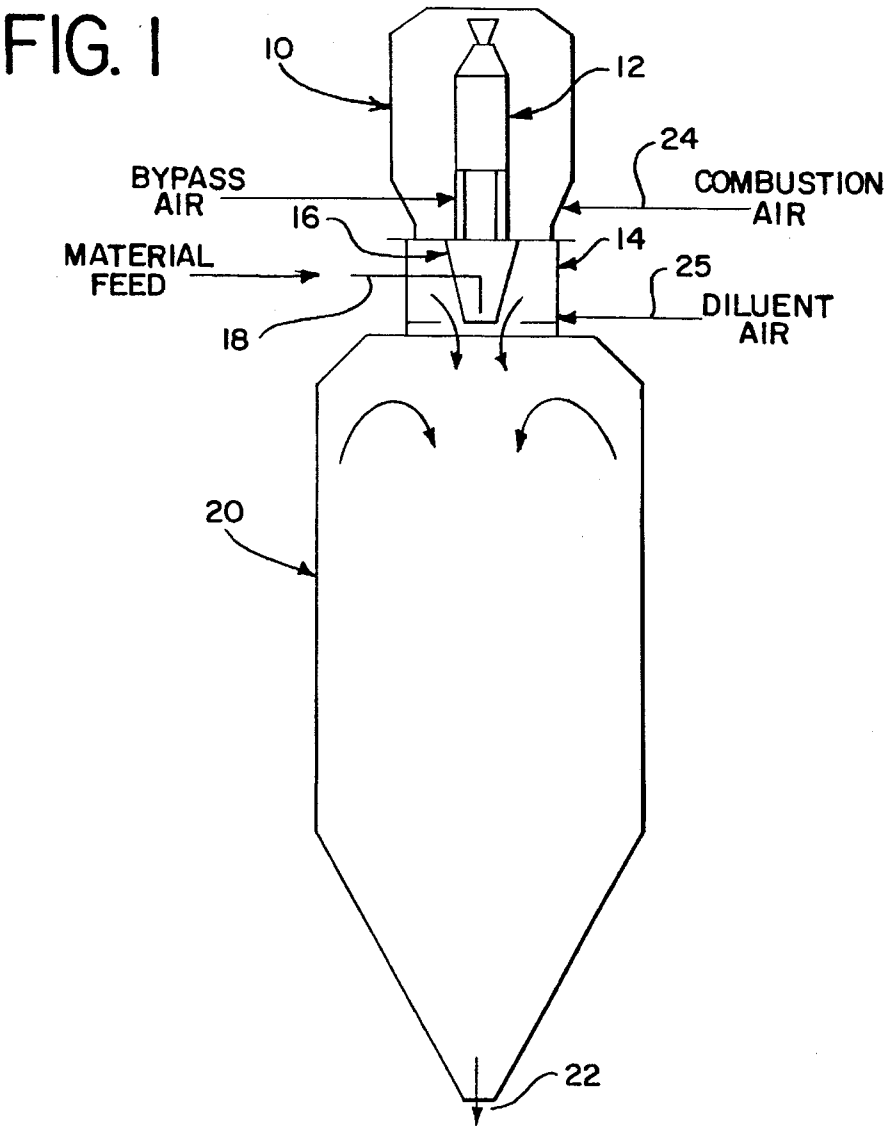
FIG. 1 is a schematic illustration of a pulse combustion drying system including a drying chamber of the invention.

FIG. 1 provides a schematic illustration of a system of the type incorporating the concepts of this invention. This system comprises an upper housing 10 having a pulse combustor unit 12 including a pulse combustion chamber and tail pipe. An intermediate housing 14 includes a feed introduction chamber 16, and a feed pipe 18 for introduction of solutions or slurries is associated with this chamber.

The lower housing 20 comprises a drying chamber adapted to receive a mixture of material and gases issuing from the feed introduction chamber 16. After a predetermined time of residence in the drying chamber, material will issue from the chamber as indicated at 22 and may be directed to cyclones, bag houses, etc., in accordance with conventional practice. As shown in FIG. 1 at 24, combustion air is fed into the housing 10 for operation of the pulse combustor. As explained in detail in the aforementioned U.S. Pat. No. 5,252,061, this system also contemplates the introduction of additional air as shown at 25 to achieve certain beneficial results.

Figure 3:
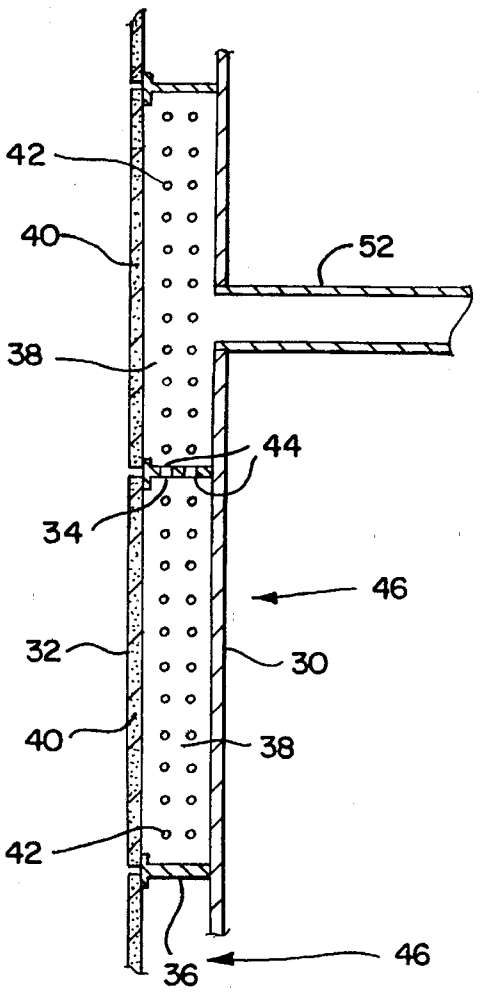
FIG. 3 is a fragmentary cross-sectional view of a plenum section of a drying chamber characterized by the features of the invention.
Figure 2:
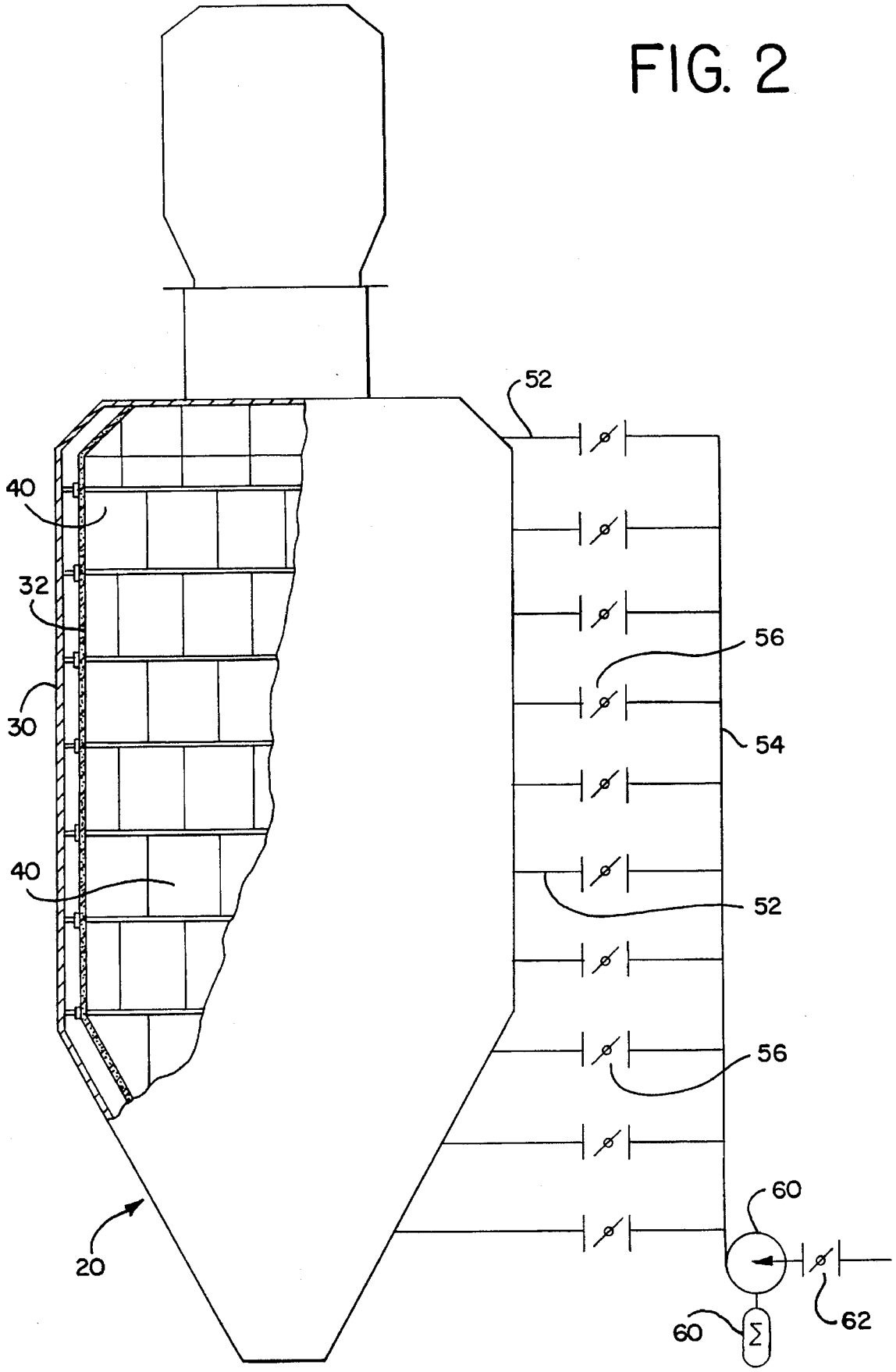
FIG. 2 is a vertical elevational view, partly cut away, of the drying chamber of the invention.

The drying chamber 20 consists of outer wall 30 which serves to confine the material being fed to the chamber. As best shown in FIGS. 2 and 3, inner wall 32 is constructed in spaced-relationship with the outer wall.

The inner wall is formed by attaching horizontal and vertical struts or supports 34, 36 and 38 to the inner wall. Individual panels 40 are then welded or otherwise attached to the supports to form inner wall 32. The panels may be curved to facilitate conformance with the preferred cylindrical shape of the drying chamber. The panels can be placed in specific areas or throughout the drying chamber.

The form of the invention shown in FIG. 3 illustrates the annular space being divided into vertically-spaced plenums 46. The vertical struts 38 are provided with holes 42 so that air may pass freely between horizontally-spaced sections of a plenum all around the chamber wall. Similarly, the horizontal struts 34 define holes 44 so that air may pass vertically between upper and lower areas of the plenum shown. The upper and lower horizontal struts 36 shown in FIG. 3 are, however, solid to thereby prevent air movement to vertically adjacent plenum sections 46. The panels can be fed by a single or many plenums depending upon the material being dried.

Air or other fluid is introduced to a plenum section through pipes 52. As shown in FIG. 2, these pipes are connected to a common source of fluid supply through manifold 54. Each pipe 52 is, however, provided with a separate valve 56 so that fluid fed to a particular vertically located plenum can be controlled. Thus, a particular drying operation may call for more intense application of air under pressure in the upper section of a chamber with little or no application called for in lower sections. It is also contemplated that the inner wall could simply be excluded in the lower portion of the chamber 20.

The air pressure is controlled by fan 58 driven by motor 60. Valve 62 provides for adjustment of the fan operation to also provide a means for pressure control. Air pressure just in excess of atmospheric pressure and up to two atmospheres is contemplated for a typical application. The air can be heated or cooled depending upon the application.

The panels 40 may take a variety of forms including screens or porous structures of various types. In one form of the invention, the panels comprise porous metal sections of 316L stainless steel formed using powder metallurgical (sintered metal) techniques by Mott Metallurgical. The panels were attached in 10" by 40" sections, ½ to 6 inches thick. Such panels are readily mounted by welding on struts formed of stainless steel typically used in the manufacture of products of this type.

Although described in terms of the operating efficiency of a drying chamber, the system of the invention may also function to achieve cooling of material fed to the chamber 20. Thus, at a minimum, the pressure of air introduced will form a film on the inner wall surface to prevent material build-up. With increased pressure forcing air into the interior, the influence on product temperature may be increased. In addition, product conditioning can be achieved particularly if fluids other than air are advantageously introduced to the chamber 20 for reacting with or otherwise influencing the condition of the material.

It will be understood that various changes and modifications may be made in the above-described invention without departing from the spirit thereof, particularly as defined in the following claims.

We claim:

1. In a particulate material drying apparatus including a pulse combustor, an associated combustion chamber, means for introducing fuel and combustion air to the combustion chamber whereby the combination of the pulse combustor and combustion chamber generates a pulsating flow of hot gases, a material feed introduction chamber receiving said hot gases, means for introducing material to be dried into said introduction chamber for contact therein with said flow of hot gases, and a drying chamber connected to said introduction chamber for receiving the mixture of material and hot gases exiting from said introduction chamber, the improvement wherein said drying chamber comprises an enclosing wall, a porous inner wall spaced inwardly from said enclosing wall, an annular space defined between said enclosing wall and said porous inner wall, and means for introducing fluid under pressure into said annular space whereby said fluid passes through said porous inner wall and deters build-up of material on the inner surface of said porous inner wall.

2. An apparatus according to claim 1 wherein said drying chamber defines a substantially cylindrical shape, said porous inner wall comprising a plurality of panels spaced inwardly of said enclosing wall.

3. An apparatus according to claim 1 including means for maintaining said fluid under pressure whereby at least a thin layer of fluid is formed on said inner surface of said porous inner wall.

4. An apparatus according to claim 3 including fan means for continuously pumping said fluid into said annular space to maintain said fluid under pressure.

5. An apparatus according to claim 1 wherein said porous wall is formed into a single or plurality of panels, and support struts mounted in said annular space for supporting said panels.

6. An apparatus according to claim 5 wherein said struts include vertically oriented struts, and holes defined by said vertically oriented struts so that fluid introduced at one location is adapted to flow through said annular space all around said chamber.

7. An apparatus according to claim 6 including horizontal struts, at least some of said horizontal struts being solid and extending all around said chamber whereby said annular space is divided into vertically-spaced sections.

8. An apparatus according to claim 7 wherein said means for introducing fluid under pressure include separate means communicating with respective vertically-spaced sections, and means for independently controlling fluid introduction by said separate means.

9. In a method for drying particulate material wherein said material is introduced to a system including a pulse combustor having an associated combustion chamber, fuel and combustion air are introduced to the combustion chamber whereby the combination of the pulse combustor and combustion chamber generates a pulsating flow of hot gases, the hot gases are fed to a material feed introduction chamber, the material to be dried is fed into said introduction chamber for contact therein with said flow of hot gases, and the mixture of material and hot gases is delivered from said introduction chamber into a drying chamber, said drying chamber comprising an enclosing wall and a porous inner wall spaced inwardly from said enclosing wall whereby an annular space is defined between said enclosing wall and said porous inner wall, the improvement comprising the step of introducing fluid under pressure into said annular space whereby said fluid passes through said porous inner wall and either treats or deters build-up of material on the inner surface of said porous inner wall.

10. A method according to claim 6 wherein said fluid is continuously maintained under pressure whereby at least a thin layer of fluid is formed on said inner surface of said porous inner wall.

11. A method according to claim 6 including the step of continuously pumping fluid into said annular space to maintain said fluid under pressure.

12. A method according to claim 8 wherein said fluid comprises air.

* * * * *